US005483317A

United States Patent [19]

Tanibata

[11] Patent Number: 5,483,317

[45] Date of Patent: Jan. 9, 1996

[54] FILM DEVELOPING DEVICE

[75] Inventor: Toru Tanibata, Wakayama, Japan

[73] Assignee: Noritsu Koki Co., Ltd., Japan

[21] Appl. No.: 232,939

[22] Filed: Apr. 25, 1994

[30] Foreign Application Priority Data

May 10, 1993 [JP] Japan ..... 5-108095

[51] Int. Cl.[6] ..... G03D 3/08

[52] U.S. Cl. ..... 354/321; 354/339

[58] Field of Search ..... 354/319–323, 354/338–340; 355/40, 41; 242/584.1, 587.3, 1, 562.1, 563, 332.4, 562; 226/91, 92; 81/488

[56] References Cited

U.S. PATENT DOCUMENTS

| | | | |
|---|---|---|---|
| 4,021,832 | 5/1977 | Krehbiel et al. | 354/298 |
| 4,047,653 | 9/1977 | Starr | 226/92 |
| 4,074,870 | 2/1978 | Kaufman | 242/1 |
| 4,113,192 | 9/1978 | Osanai | 242/1 |
| 4,138,068 | 2/1979 | Kinoshita | 243/332.4 |
| 4,283,021 | 8/1981 | Nishida | 242/562.1 |
| 4,292,115 | 9/1981 | Jones et al. | 221/272 X |
| 4,293,211 | 10/1981 | Kaufmann | 354/321 X |
| 5,229,802 | 7/1993 | Shiota et al. | 354/354 X |
| 5,231,439 | 7/1993 | Takahashi et al. | 354/320 X |
| 5,360,183 | 11/1994 | Takahashi et al. | 242/584.1 X |

FOREIGN PATENT DOCUMENTS

| | | |
|---|---|---|
| 2923992 | 1/1980 | Germany . |
| 3833498 | 7/1990 | Germany . |

OTHER PUBLICATIONS

Patent Abstracts of Japan, vol. 15, No. 24 (P–1156) 21 Jan. 1991 & JP–A–02 269 341 (Konica Corp) 2 Nov. 1990.

Patent Abstracts of Japan, vol. 16, No. 377 (P–1401) 12 Aug. 1992 & JP–A–04 120 537 (Fuji Photo Film Co. Ltd.) 21 Apr. 1992.

*Primary Examiner*—D. Rutledge

*Attorney, Agent, or Firm*—Townsend and Townsend and Crew

[57] ABSTRACT

A film developing apparatus includes a loading section for receiving a film holder, a developing section, a film transport device for transporting a film protruding from a film feed opening of the film holder to the developing section, and a film drawing device for drawing a leader of the film in the film holder mounted in the loading section, out through the film feed opening.

12 Claims, 4 Drawing Sheets

FILM DEVELOPING DEVICE

BACKGROUND OF THE INVENTION

1. Field of the Invention

The present invention relates to film developing apparatus, and more particularly to a film developing apparatus having a loading section for receiving a film holder, a developing section, and a film transport device for transporting a film protruding from a film feed opening of the film holder to the developing section.

2. Description of the Related Art

With the above film developing apparatus, a film to be developed is placed together with its holder in the loading section, and the film transport device transports the film protruding from the film feed opening of the holder to the developing section.

To enable the transport device to transport the film, the leader of the film must protrude from the film feed opening. For this purpose, a special device has been used heretofore to draw the leader of the film from inside the film holder. After the leader is drawn out by the special device, the film holder is placed in the loading section of the film developing apparatus.

Thus, a film developing process involves an operation to transfer the film holder from the special device for drawing the leader of the film to the film developing apparatus. This results in a low operating efficiency.

SUMMARY OF THE INVENTION

The present invention has been made having regard to the state of the art noted above, and its object is to improve the efficiency of the film developing process.

The above object is fulfilled, according to the present invention, by a film developing apparatus comprising a loading section for receiving a film holder, a developing section, a film transport device for transporting a film protruding from a film feed opening of the film holder to the developing section, and a film drawing device for drawing a leader of the film in the film holder mounted in the loading section, out through the film feed opening.

With this construction, the film drawing device draws the leader of the film from the film holder mounted in the loading section, so that the leader protrudes from the film feed opening of the holder. Thereafter the film transport device transports the film from the film feed opening to the developing section to develop the film.

Thus, the film developing apparatus may receive in the loading section a film holder having the leader of a film not protruding from the film feed opening thereof. The film may be developed without requiring transfer of the film holder after the film leader is drawn out of the film holder. This apparatus, therefore, is capable of an efficient film developing process.

The film developing apparatus may include a detecting device for detecting whether the leader of the film protrudes from the film holder mounted in the loading section. In this case, the film drawing device is operable to draw the film when the detecting device does not detect the film leader.

When the detecting device does not detect a film protruding from the film holder mounted in the loading section, the film drawing device carries out a drawing operation to draw the film out of the film feed opening. Then, the transport device transports the protruding film to the developing section.

When the detecting device detects the leader of a film protruding from the film feed opening of a film holder mounted in the loading section, the transport device transports the protruding film to the developing section, without requiring the operation of the film drawing device.

Consequently, the film transport device properly transports the film to the developing section whether or not the leader of the film protrudes from the film feed opening of the film holder mounted in the loading section. This construction realizes a still more convenient film developing apparatus.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

A film developing apparatus according to the present invention will be described in detail with reference to the drawings.

Figure 1:
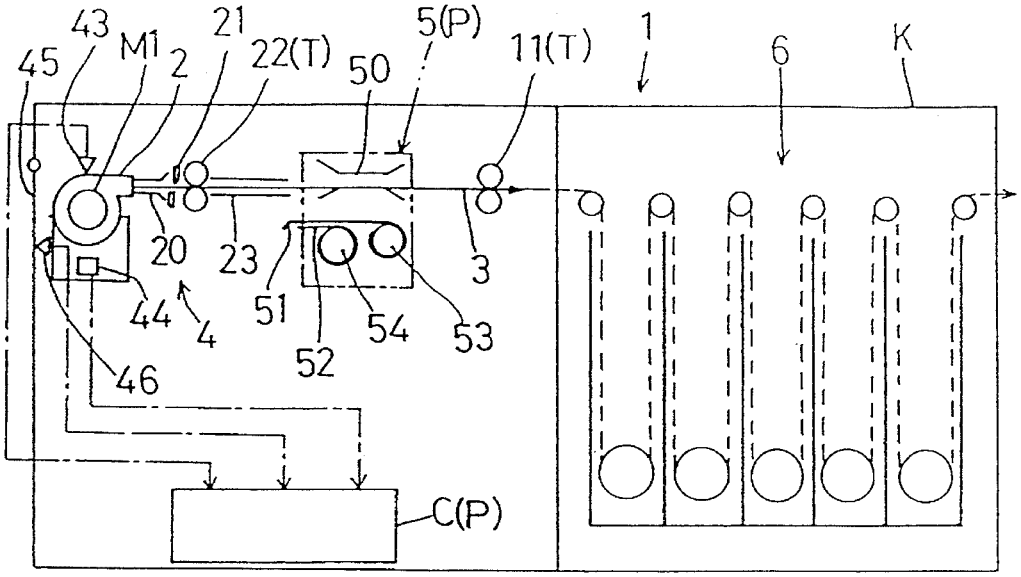
FIG. 1 is a schematic view of a film developing apparatus according to the present invention.

As shown in FIG. 1, the film developing apparatus 1 includes a loading section 4 for receiving a film holder or cartridge 2, a leader drawing unit 5 for drawing the leader of a film 3 from inside the cartridge 2, a developing section 6 for developing the film 3 drawn from the cartridge 2, rollers 11 and 22 for transporting the film 3 to the developing section 6, and a control unit C for controlling operations of the various components.

When the cartridge 2 is placed in the loading section 4, the leader drawing unit 5 draws the leader of the film 3 from inside the cartridge 2 under control of the control unit C. The film 3 drawn from the cartridge 2 is transported to the developing section 6 by the rollers 11 and 22 interlocked through a belt not shown.

Each component will be described hereinafter.

Figure 2:
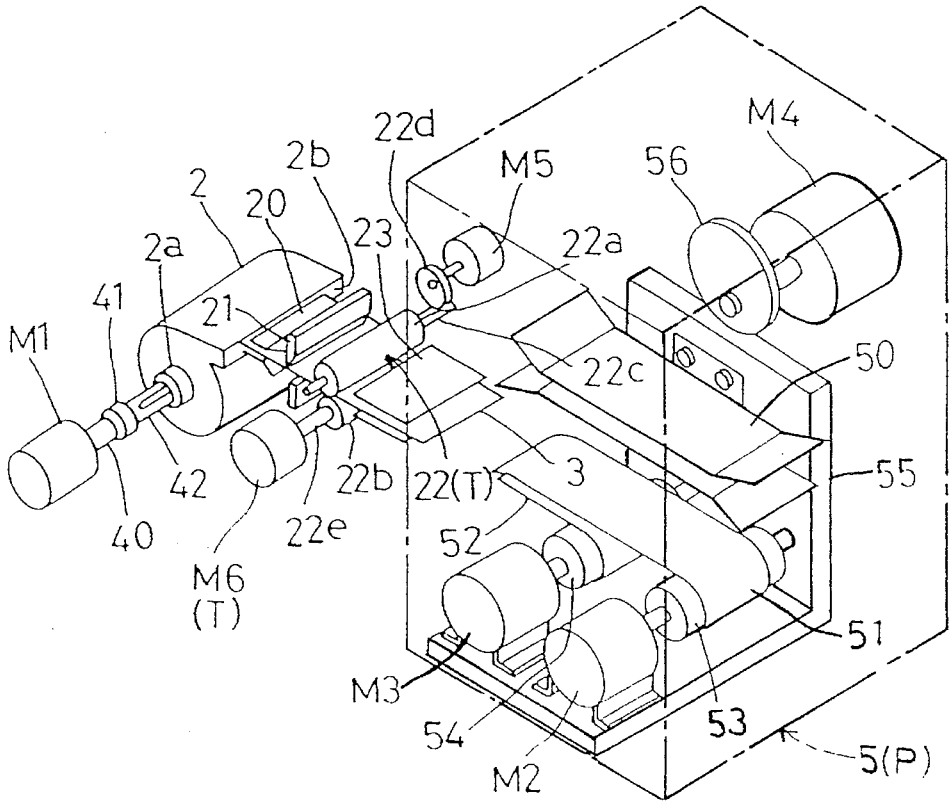
FIG. 2 is a perspective view of a principal portion of the apparatus shown in FIG. 1.
Figure 3:
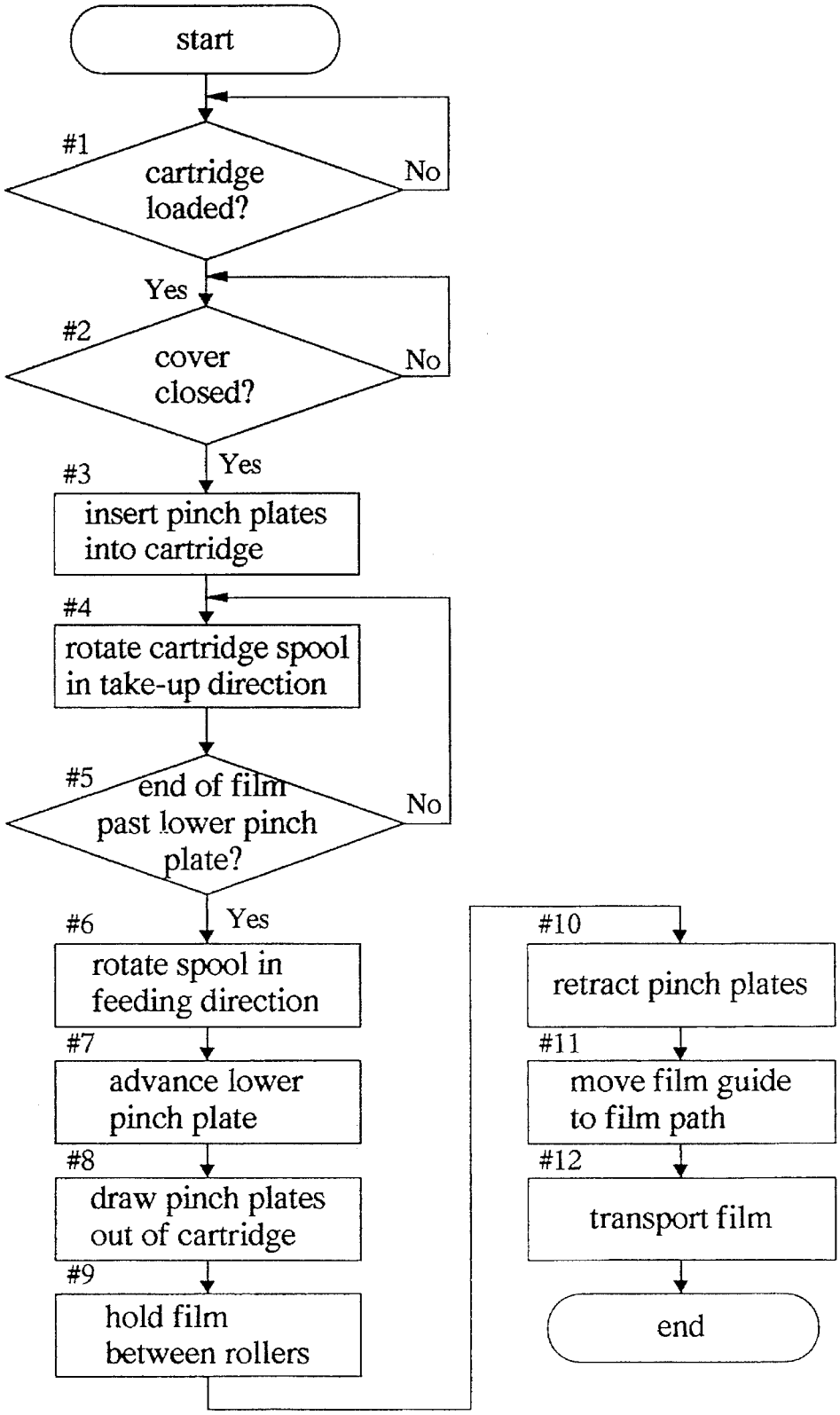
FIG. 3 is a flowchart showing operation of the apparatus shown in FIG. 1.
Figure 4A:
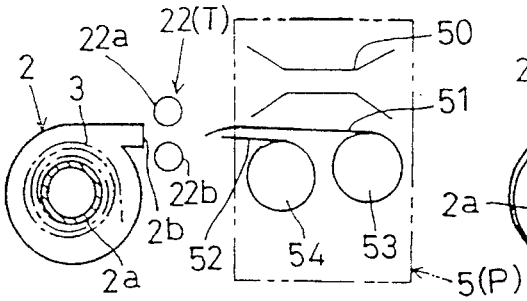
FIGS. 4 (*a*) to (*h*) are explanatory views of the operation of the apparatus shown in FIG. 1.
Figure 4B:
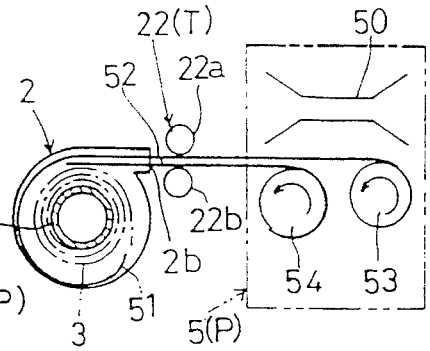
Figure 4C:
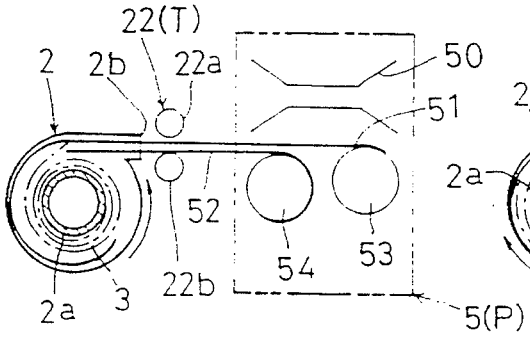
Figure 4D:
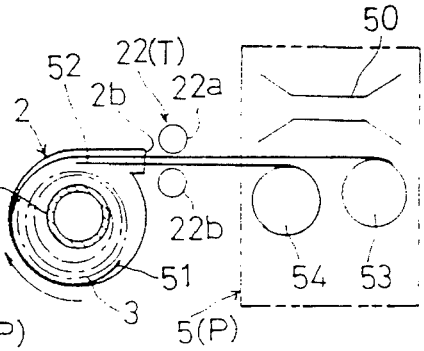
Figure 4E:
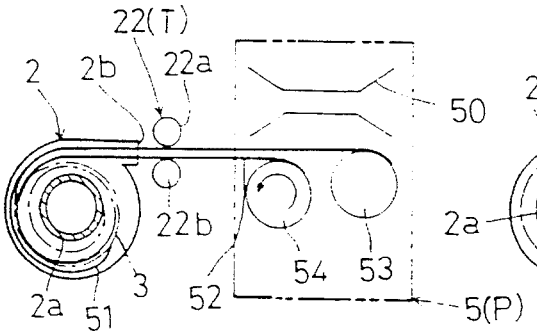
Figure 4F:
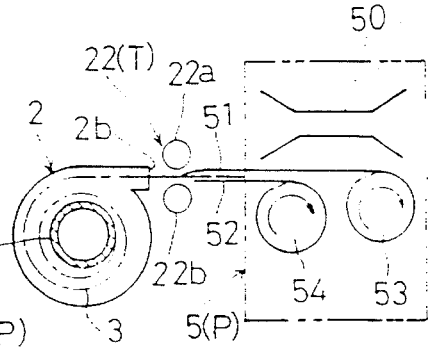
Figure 4G:
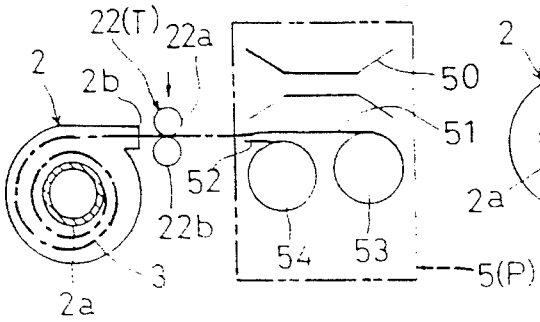
Figure 4H:
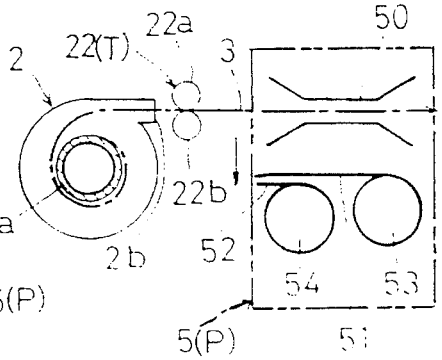

As shown in FIG. 2, the loading section 4 includes a motor M1 acting as a driving device for rotating a spool 2*a* of the cartridge 2. The motor M1 has a rotary shaft 40 connected through a coupling 41 to a bifurcate support rod 42 extending into the spool 2*a* in the form of a bottomed tube. The support rod 42 is spring-loaded to press on inner walls of the spool 2*a*. The loading section 4 further includes a cartridge detecting sensor 43 in the form of an optical sensor for checking presence or absence of the cartridge 2, and a flapping sound detecting sensor 44 in the form of a capacitor microphone for detecting the leader of the film 3 to be drawn out as described later.

The cartridge 2 is placed in the loading section 4 after opening a cover 45 attached to a casing K of the film developing apparatus 1. The cover 45 has a cover detecting sensor 46 in the form of a proximity sensor for detecting opening and closing of the cover 45.

As shown in FIG. 2, the leader drawing unit 5 includes a film guide 50 for guiding the film 3 in a horizontal direction, an upper leader pinch plate 51 and a lower leader pinch plate 52 in the form of elastic metal strips for gripping the film 3 therebetween, a spindle 53 for fixedly holding one end of the upper leader pinch plate 51 and winding the upper leader pinch plate 51, a spindle 54 for fixedly holding one end of the lower leader pinch plate 52 and winding the lower leader pinch plate 52, a motor M2 for rotating the spindle 53, and a motor M3 for rotating the spindle 54. These components are attached to a support deck 55, with the film guide 50 disposed in a top position. To grip the film 3 reliably, the upper leader pinch plate 51 has a tip end thereof bent with a suitable radius of curvature.

The support deck 55 is vertically slidable along a rail or rails not shown, and biased upward by a spring not shown. The support deck 55 has an upper end thereof contacting an eccentric cam 56 rotatable by a motor M4 to limit upward movement of the support deck 55.

With rotation of the motor M4, the support deck 55 is switchable between a position to place the film guide 50 at a level of transport of the film 3, and a position to place the upper leader pinch plate 51 and lower leader pinch plate 52 unwound from the spindles 53 and 54 at the level of transport.

Though not shown in the drawings, guide plates are arranged around the upper leader pinch plate 51 and lower leader pinch plate 52. These guide plates direct movement of the upper leader pinch plate 51 and lower leader pinch plate 52 toward the cartridge 2 as driven by the motors M2 and M3.

Figure 5:
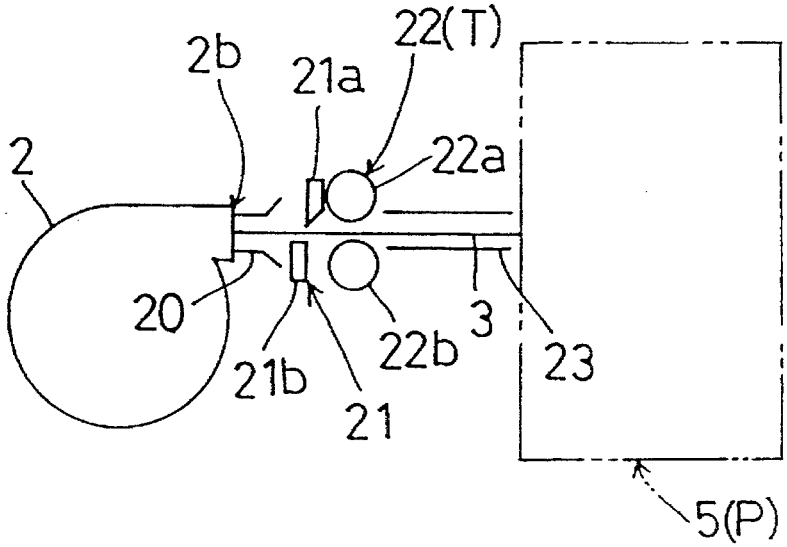
FIG. 5 is a schematic view of the principal portion of the apparatus shown in FIG. 1.

As shown in FIGS. 2 and 5, the apparatus includes, arranged between the loading section 4 and leader drawing unit 5, a first pinch plate guide 20, a film cutter 21 consisting of an upper blade 21*a* and a lower blade 21*b*, the rollers 22, and a second pinch plate guide 23.

The lower blade 21*b* of the film cutter 21 is fixed, while the upper blade 21*a* is pivotable by a solenoid or the like not shown. When the film 3 has been drawn from the cartridge 2, the upper blade 21*a* is pivoted to cut the film 3 between the two blades 21*a* and 21*b*.

The upper one 22*a* of the rollers 22 includes a rotary shaft 22*c* having opposite ends thereof vertically slidably supported by slide rails not shown, and biased upward by springs not shown. One end of the rotary shaft 22*c* is in contact with an eccentric cam 22*d* connected to a motor M5 to limit upward movement of the upper roller 22*a*.

With rotation of the motor M5, the upper roller 22*a* slides along the slide rails not shown. Thus, the upper roller 22*a* is movable between a lower limit for pressure contact with the lower roller 22*b*, and an upper limit spaced from the lower roller 22*b* for allowing passage of the film 3, the upper leader pinch plate 51 and lower leader pinch plate 52 free of resistance.

The lower roller 22*b* has a rotary shaft 22*e* connected to a motor M6 acting as a driving device. The motor M6 is operable to transport the film 3 with the upper roller 22*a* placed in the lower limit in pressure contact with the lower roller 22*b*.

A process of drawing the leader of the film 3 from inside the cartridge 2 under control of the control unit C will be described with reference to FIGS. 1 through 4.

In an initial state, as shown in FIG. 4 (*a*), the leader drawing unit 5 has the upper leader pinch plate 51 and lower leader pinch plate 52 lying at the level of transport of the film 3. The upper roller 22*a* and lower roller 22*b* are separated from each other.

In the above initial state, the apparatus waits until the cartridge detecting sensor 43 detects a cartridge 2 placed in the loading section 4 (step #1). When placing the cartridge 2 in the loading section 4, an end of the first pinch plate guide 20 opposed to the loading section 4 is inserted into a film feed opening 2*b* of the cartridge 2.

After presence of the cartridge 2 is confirmed, the apparatus waits until the cover detecting sensor 46 detects closure of the cover 45 of the loading section 4 (step #2).

When closure of the cover 45 is confirmed, the motors M2 and M3 are actuated to rotate the spindles 53 and 54 and insert the upper leader pinch plate 51 and lower leader pinch plate 52 into the cartridge 2 (step #3). As shown in FIG. 4 (*b*), the lower leader pinch plate 52 is inserted to a depth with a tip end thereof lying adjacent the film feed opening 2*b*, while the upper leader pinch plate 51 is inserted deeper into the cartridge 2 than the lower leader pinch plate 52.

Next, the motor M1 is driven to rotate the spool 2*a* of the cartridge 2 in a direction to take up the film 3 into the cartridge 2, i.e. counterclockwise in FIG. 4 (step #4).

The spool 2*a* is rotated until the flapping sound detecting sensor 44 detects a flapping sound made by a leading end of the film 3 moving past the lower leader pinch plate 52 (step #5).

After confirming detection of the flapping sound, the motor M1 is stopped to hold the leading end of the film 3 in the position shown in FIG. 4 (*c*). Then, the motor M1 is driven again to rotate the spool 2*a* in the direction to protrude the film 3 from the cartridge 2, i.e. clockwise in FIG. 4 (step #6). As a result, as shown in FIG. 4 (*d*), the film 3 is spread outward and pressed on an inner wall of the cartridge 2.

In this state, the motor M3 is driven to advance the lower leader pinch plate 52 until its tip end reaches the tip end of the upper leader pinch plate 51 as shown in FIG. 4 (*e*) (step #7). Then, the motors M2 and M3 are driven to draw the upper leader pinch plate 51 and lower leader pinch plate 52 out of the cartridge 2 (step #8). Consequently, as shown in FIG. 4 (*f*), the film 3 is drawn out of the cartridge 2 as pinched between the tip ends of the upper leader pinch plate 51 and lower leader pinch plate 52.

Once the film 3 is drawn out of the cartridge 2, the motor M5 is driven to hold the film 3 under pressure between the upper roller 22*a* and lower roller 22*b* as shown in FIG. 4 (*g*) (step #9). Then, the upper leader pinch plate 51 and lower leader pinch plate 52 are retracted into the leader drawing unit 5 (step #10).

Next, as shown in FIG. 4 (*h*), the motor M4 is driven to move the film guide 50 to the level of transport of the film 3 (step #11). Subsequently, the motor M6 is driven to rotate the rollers 22 to draw and transport the film 3 (step 12).

Thus, the rollers 11 and 22 and motor M6 act as a film transport device T for transporting the film 3 protruding from the film feed opening 2*b* of the cartridge 2 to the developing section 6. The control unit C and leader drawing unit 5 act as a film drawing device P.

Figure 6:
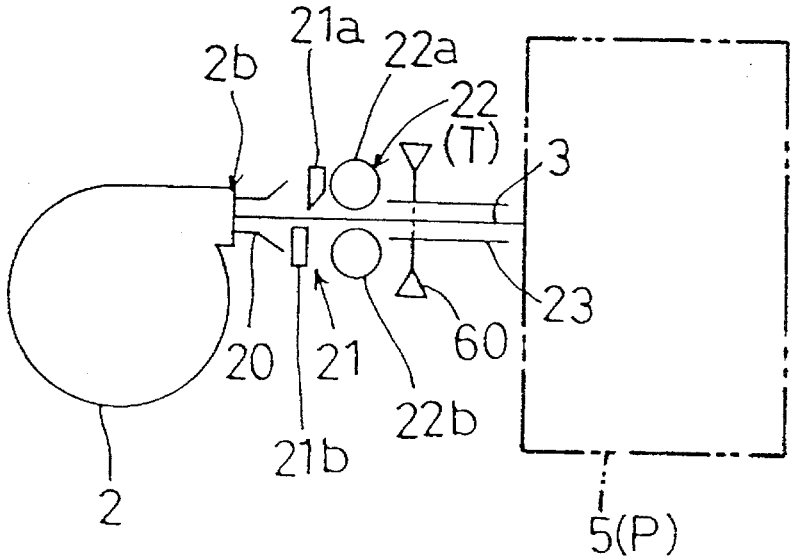
FIG. 6 is a schematic view of a principal portion of a different embodiment of the invention.

The above embodiment may be modified as follows:

(1) The above embodiment processes the film 3 having a leader contained in the cartridge 2 mounted in the loading section 4. As shown in FIG. 6, a film detecting sensor 60 in the form of an optical sensor may be disposed on the film transport path downstream of the rollers 22 for detecting whether the leader of the film 3 protrudes from the cartridge 2 or not. Then, the apparatus may be able to process a film 3 having a leader already protruding from a cartridge 2 mounted in the loading section 4 as well as a film 3 having a leader contained in a cartridge 2 mounted in the loading section 4.

That is, when the film detecting sensor 60 detects a leader of a film 3 protruding from a cartridge 2 mounted in the loading section 4, the control unit C controls the motor M4 to move the support deck 55 of the leader drawing unit 5 to place the film guide 50 at the level of transport of the film 3. Then, the film 3 is held under pressure between the rollers 22, and transported straight to the developing section 6.

When the film detecting sensor 60 does not detect the leader protruding from the cartridge 2 mounted in the loading section 4, the film drawing device P carries out a drawing operation as in the foregoing embodiment.

(2) The foregoing embodiment handles the cartridge 2 as an example of film holders. However, the invention is applicable to film holders of different sizes and shapes.

What is claimed is:

1. A film developing apparatus comprising:

a film holder holding a film;

a loading section for receiving said film holder;

a developing section for developing said film;

film transport means for transporting said film protruding from a film feed opening of said film holder to said developing section;

film drawing means for drawing a leader of said film in said film holder mounted in said loading section, out through said film feed opening; and a film guide for guiding the film drawn from said film holder;

wherein said film drawing means includes upper and lower leader pinch plates for together pinching the film therebetween to draw the film from said film holder, drive means for driving said upper leader pinch plate from the outside of said film holder to the inside thereof, further drive means for driving said lower leader pinch plate from the outside of said film holder to the inside thereof, and a control unit for controlling various components, said control unit being capable of selectively providing a state where said film guide is positioned at a height where the film is to be transported and a further state where said upper and lower leader pinch plates are positioned at said height.

2. A film developing apparatus as defined in claim 1, wherein said film transport means includes rollers for transporting said film to said developing section, and means for driving said rollers.

3. A film developing apparatus as defined in claim 1, wherein said film drawing means includes a control unit for controlling various components, and a leader drawing unit operable under control of said control unit to draw said leader of said film out of said film holder when said film holder is mounted in said loading section.

4. A film developing apparatus as defined in claim 3, wherein said loading section includes drive means for rotating a spool of said film holder.

5. A film developing apparatus as defined in claim 4, wherein said loading section includes an optical sensor for detecting presence of said film holder, and a flapping sound detecting sensor for detecting a flapping sound made by said leader of the film moving past said lower leader pinch plate.

6. A film developing apparatus as defined in claim 3, further comprising a film cutter disposed between said loading section and said leader drawing unit for cutting said film when said film has been drawn our of said film holder.

7. A film developing apparatus as defined in claim 1, further comprising detecting means for detecting whether said leader of said film protrudes from said film holder mounted in said loading section, wherein said film drawing means is operable to draw said film when said detecting means fails to detect said leader.

8. A film developing apparatus as defined in claim 7, wherein said detecting means is an optical sensor.

9. A method for retrieving a film from a film holder within a film developing apparatus comprising the following steps:

loading a film holder into a loading section of a film developing apparatus, said loading step including the step of closing an access door over the film holder so to as keep ambient light from the film holder during the subsequent steps;

inserting a film retrieval element into the film holder;

gripping the film within the film holder by the film retrieval element;

pulling the film from the film holder by the film retrieval element; and directing the film along a film path for development within the film developing apparatus.

10. The method according to claim 9 wherein the inserting step is carried out by inserting first and second flexible, resilient pinch plates into the film holder with a distal end of the first pinch plate positioned against an outside wall of the film holder and a distal end of the second pinch plate positioned between the first pinch plate and the film.

11. A method for retrieving a film from a film holder within a film developing apparatus comprising the following steps:

loading a film holder into a loading section of a film developing apparatus;

inserting a film retrieval element into the film holder by inserting first and second flexible, resilient pinch plates into the film holder with a distal end of the first pinch plate positioned against an outside wall of the film holder and a distal end of the second pinch plate positioned between the first pinch plate and the film;

gripping the film within the film holder by the film retrieval element;

pulling the film from the film holder by the film retrieval element; and directing the film along a film path for development within the film developing apparatus.

12. The method according to claim 11 wherein the gripping step is carried out by:

rotating the film in a first rotary direction within the film holder until an outer film end passes the distal end of the second pinch plate;

aurally sensing the passage of the outer film end past the distal end of the second pinch plate;

rotating the film in a second rotary direction; and advancing the distal end of the second pinch plate until the film is secured between the first and second pinch plates.

* * * * *